US005121859A

United States Patent [19]

Stull

[11] Patent Number: 5,121,859

[45] Date of Patent: Jun. 16, 1992

[54] NON-RESEALABLE DISPENSER CAP CONSTRUCTION

[76] Inventor: Gene Stull, 1086 Hacklebarney Rd., Chester Township, N.J. 07930

[21] Appl. No.: 756,275

[22] Filed: Sep. 6, 1991

Related U.S. Application Data

[63] Continuation of Ser. No. 504,006, Apr. 4, 1990, Pat. No. 5,046,646.

[51] Int. Cl.[5] ..... B65D 47/10

[52] U.S. Cl. ..... 222/541; 215/252; 215/253; 215/263; 220/266; 222/546; 222/562; 222/563

[58] Field of Search ..... 222/147, 153, 476, 522, 222/546, 525, 562, 575, 541, 563; 215/32, 33, 252, 253, 263; 220/265, 266

[56] References Cited

U.S. PATENT DOCUMENTS

| | | | |
|---|---|---|---|
| 2,734,665 | 2/1956 | Flamm | 222/563 X |
| 3,143,257 | 8/1964 | Mumford | 222/575 X |
| 3,255,937 | 6/1966 | Jarrett | 222/575 X |
| 4,415,094 | 11/1983 | Bavnsfelt | 215/252 |
| 4,424,918 | 1/1984 | Stull | 222/153 |
| 4,546,893 | 10/1985 | Stull | 215/252 |
| 4,702,383 | 10/1987 | Wender | 215/252 X |
| 4,770,305 | 9/1988 | Su | 215/250 |
| 4,773,551 | 9/1988 | Rizzardi | 215/253 |
| 4,821,897 | 4/1989 | Weiler | 215/32 |
| 4,826,055 | 5/1989 | Stull | 222/575 X |
| 5,046,646 | 9/1991 | Stull | 222/541 |

*Primary Examiner*—Kevin P. Shaver

*Attorney, Agent, or Firm*—H. Gibner Lehmann; K. Gibner Lehmann

[57] ABSTRACT

A non-resealable dispenser cap construction having an elongate tapered, stepped hollow spout member with an exterior shoulder intermediate its ends, and a discharge orifice. A closure cap member having a transverse closure wall is mounted on the spout member with the transverse wall engaging and closing over the discharge orifice. With the closure cap member so mounted, the transverse closure wall is distorted and biased by its engagement with the wall of the discharge orifice. One of the members is formed with two oppositely-disposed frangible tabs which overlie and are permanently attached to the other member, and each tab has a zone of weakness which can be readily ruptured upon the application of opposing rotative forces to the members. With the cap member removed the orifice is exposed, permitting discharge of the container contents through the spout member. Re-sealing of the cap member on the spout member is prevented, due to a lack of interengageable parts on the two members.

8 Claims, 1 Drawing Sheet

NON-RESEALABLE DISPENSER CAP CONSTRUCTION

CROSS REFERENCES TO RELATED APPLICATIONS this is a continuation of U.S. application Ser. No. 07/504,006 filed Apr. 4, 1990, now U.S. Pat. No. 5,046,646.

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to hand-held dispensers, and more particularly to cap constructions therefor, which resist resealing following initial opening and use.

2. Description of the Related Art Including Information Disclosed Under 37 CFR §§1.97-199

My U.S. Pat. No. 4,424,918 issued Jan. 10, 1984 and entitled NON-RESEALABLE DISPENSER CAP CONSTRUCTION discloses a cap having a base member carried on the neck of a bottle or container, and a twist cap turnably moveable on the base member. Cooperable camming structures on the base member and twist cap effect axial shifting of the latter when it is turned. Interference or detent beads arranged to by-pass one another during the initial axial shifting of the twist cap, resist any tendency for the consumer to re-seal the twist cap once it has been initially unscrewed.

My U.S. Pat. No. 4,546,893 issued Oct. 15, 1985 and entitled TAMPER-EVIDENT CLOSURE CAP CONSTRUCTION discloses a twist cap having a plurality of frangible webs connecting the twist cap to a base member. Upon initial unscrewing of the twist cap, the webs break to thereafter provide to the consumer, a visual indication that tampering has occurred.

U.S. Pat. No. 4,821,897 issued Apr. 18, 1989 to G. Weiler, and entitled CONTAINER WITH AN INSERT HAVING A FULLY OR PARTIALLY ENCAPSULATING SEAL WITH A FRANGIBLE WEB FORMED AGAINST SAID INSERT, discloses a twist cap construction employing frangible webs and a conical stopper which is received in a discharge opening to effect a seal. U.S. Pat. No. 4,773,551 issued Sep. 27, 1988, and entitled CLOSURE FOR A BOTTLE OR THE LIKE EQUIPPED WITH A DROPPER, discloses a safety cap construction employing a depending sealing plug on an overcap, which plug is receivable in a discharge orifice.

It is believed that there exists a need in the particular art with which the above patents are concerned, for an especially simple dispenser cap which effectively resists re-sealing after opening, and which can be more economically manufactured and assembled than those presently known.

SUMMARY OF THE INVENTION

Accordingly it is an object of the present invention to provide a novel and improved non-resealable dispenser cap construction which is extremely simple in its structure, and highly resistant to re-sealing, without sacrifice in ease of use or in the reliability of the initial seal.

A related object of the invention is to provide an improved non-resealable dispenser cap construction in accordance with the foregoing, which is economical to manufacture and assemble, thereby keeping the overall fabricating costs as low as possible.

Still another object of the invention is to provide an improved non-resealable dispenser cap construction of the kind indicated, wherein the individual parts can be economically molded of plastic, in simple mold cavities.

A still further object of the invention is to provide an improved non-resealable dispenser cap construction as above set forth, which is especially easy to use, and which automatically achieves the desired, non-resealing function without having to rely upon special instructions or know-how on the part of the consumer.

In accomplishing the above objects the invention provides a non-resealable dispenser cap construction comprising an elongate tapered, stepped hollow spout member having an exterior shoulder intermediate its ends to form a tip portion of reduced girth in which there is a discharge orifice, means for attaching the spout member over the opening of a container, and a tapered closure cap member in the form of a cup having a transverse closure wall. The cap member is mounted on the tip portion of the spout member with the transverse wall of the cap member engaging and closing over the discharge orifice. As this is done, the transverse closure wall is distorted and biased by its engagement with the orifice wall. The said spout and cap members have exterior conical surfaces which essentially constitute continuations of each other. One of the members has a frangible tab which overlies and is permanently attached to the other member, and the tab has a zone of weakness which can be readily ruptured upon the application of opposing rotative forces to the members whereby the cap member can be removed to expose the orifice for the discharge of the container contents. The arrangement is such that the transverse closure wall of the cap member interferes with and blocks retentive return of the cap member on the spout member. An especially simple and effective non-resealable function is thus achieved.

Other features and advantages will hereinafter appear.

DESCRIPTION OF THE PREFERRED EMBODIMENT

Figure 1:
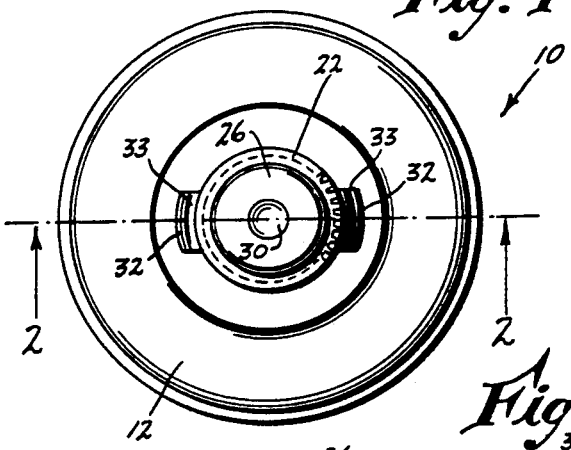
FIG. 1 is a top plan view of the improved non-resealable dispenser cap construction of the present invention.
Figure 4:
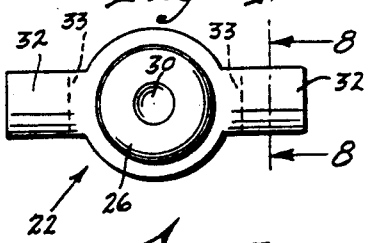
FIG. 4 is a top plan view of the closure cap member of the dispenser cap construction of FIGS. 1-3.
Figure 2:
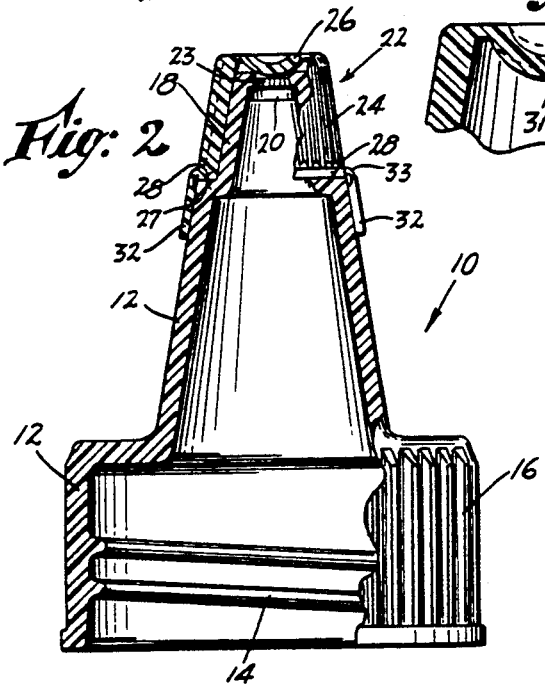
FIG. 2 is a view, partly in front elevation and partially in vertical section taken on the line 2—2 of FIG. 1, and particularly showing a hollow spout member and a tapered closure cap member carried thereon.
Figure 3:
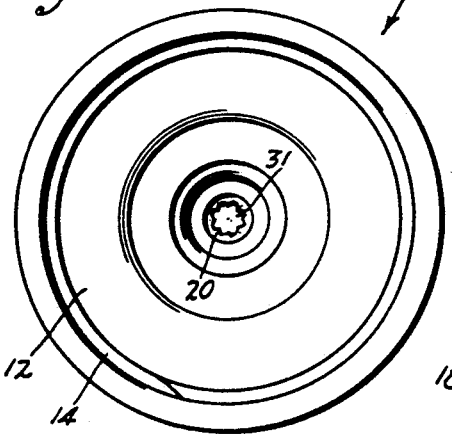
FIG. 3 is a bottom plan view of the dispenser cap construction shown in FIGS. 1 and 2.

Referring first to FIGS. 1-3 there is illustrated a dispenser cap construction generally designated by the numeral 10 comprising a hollow base or spout member 12 having an annular skirt with internal screw threads 14 for engagement with cooperable external threads on the neck of a bottle or container. The skirt has knurling 16. The spout member 12 has a tip portion 18 of reduced girth, containing a discharge orifice 20, having an upper wall portion 21 of circular configuration and a lower portion 23 having a scalloped or undulating wall; alternately, a wall having another type of non-circular configuration could also be employed, as will be explained below.

A closure cap member 22 is mounted on the tip portion, and has the form of an inverted cup comprising an annular body portion 24 and a transverse top wall 26. The exterior surface is preferably provided with gripper ribs, as shown. The inner surface is tapered to conform to the taper of the exterior surface of the spout member 12.

In accordance with the present invention the transverse top wall 26 of the closure cap member 22 is yieldable to an extent, and there are provided, on the spout member 12 and closure cap members 22, frangible means normally connecting the two members and biasing the top wall 26, with limited deformation, into sealing engagement with the wall of the discharge orifice 20. In addition, cooperable positioning means are provided on the spout member 12 and closure cap member 22, for limiting the deformation of the top wall 26 to a predetermined, desired extent.

Figure 5:
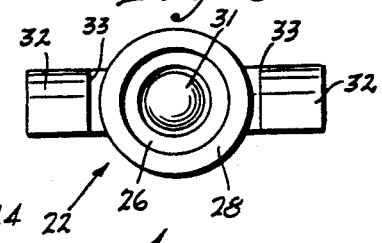
FIG. 5 is a bottom plan view of the closure cap member of FIG. 4.
Figure 6:
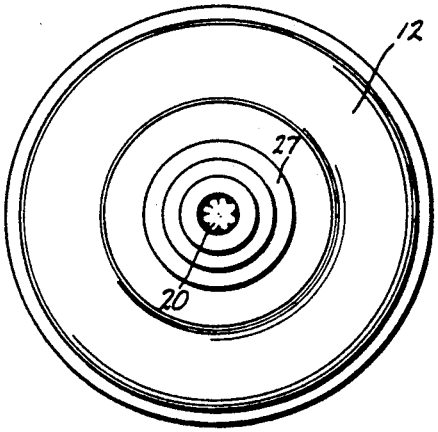
FIG. 6 is a top plan view of the spout member of the dispenser cap construction of FIGS. 1-3.

In accomplishing the desired sealing pressure of the top wall 26, the exterior of the spout member 12 is formed to have an upwardly facing shoulder 27, FIGS. 2 and 6, preferably of annular configuration. On the closure cap member 22, there is provided a bottom rim 28, FIG. 5, adapted to seat against the shoulder 27 of the spout member when the closure cap member 22 is mounted thereon. By the invention, the transverse wall 26 of the closure cap member 22 is bowed inwardly as shown, and, in the case of a uniform thickness wall, presents a concave exterior surface 30, FIG. 9, and a convex inner or bulbous surface or projection 31.

Figure 9:
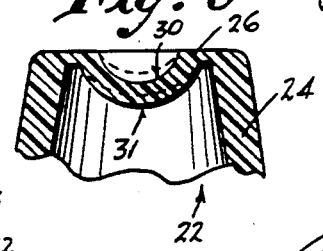
FIG. 9 is a fragmentary section of the closure cap member of FIGS. 4 and 5, showing the deformation of the top wall thereof as occurs when the cap member is assembled to the spout member.

FIG. 9 is a fragmentary section of the closure cap member 22 showing in solid outline, the transverse top wall 26 in its undeformed condition, as it would appear immediately after molding. Shown in dotted outline is the transverse top wall 26 in the configuration it would assume after it is applied to the spout member 12, and with the bottom rim 28 firmly seated against the upwardly facing shoulder 27 of the spout member 12. The deformed concave exterior surface of the wall 26 is shown a lying above the original exterior concave surface in this figure. It is to be noted that the dimensions of the closure cap member 22 are such as to cause the deformation of the transverse top wall 26 in the manner of FIG. 9, as the closure cap member 22 is being seated on the shoulder 27 of the spout member 12, such that a predetermined, desired pressure is exerted by the wall 26 at the circular point 21 of engagement with the top edge of the discharge orifice 20.

Further, by the invention, the closure cap member 22 is mounted on the spout member 12 by means of frangible tabs 32, illustrated in FIGS. 1, 2, 4, 5 and 7. These tabs 32 are preferably molded integral with the closure cap member 22, and are arranged to overlie and be sonically welded to the spout member 12 after the closure cap member 22 is installed. Two such tabs 32 are illustrated, diametrically opposite to one another, although three or more tabs could be employed if desired. The tabs 32 have thin lines of weakness 33, FIGS. 2 and 5.

Figure 8:
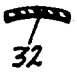
FIG. 8 is a section taken on the line 8—8 of FIG. 4.
Figure 7:
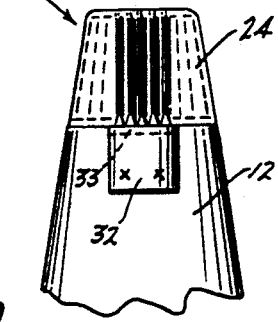
FIG. 7 is a fragmentary side elevation of the dispenser cap construction of FIGS. 1-3, particularly showing a frangible tab initially joining the spout member and closure cap member.
Figure 10:
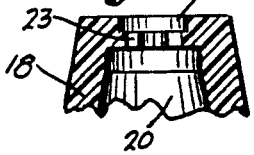
FIG. 10 is a fragmentary vertical section of the spout member, illustrating in greater detail the particular configuration of the discharge orifice.

As illustrated, both the spout member 12 and the closure cap member 22 have conical exterior surfaces, which are essentially continuations of one another, as in FIG. 2. The tabs 32 extend radially outwardly of the wall of the spout member 12. They preferably have a curved cross section as in FIG. 8, so as to accommodate the curvature of the body portion of the spout member 12.

In use, the closure cap member 22 is applied to the spout member 12 in the manner of FIG. 2, until the bottom rim 28 of the closure cap member 22 arrives at the upwardly-facing shoulder 27 of the spout member 12, and firmly engages it. The parts are so dimensioned that just prior to the engagement of the rim 28 and shoulder 27, the yieldable top wall 26 engages the circular portion 21 of the wall of the discharge opening 20. With the closure cap member 22 fully seated, the top wall 26 undergoes a desired, predetermined deformation, to the dotted line position as indicated in FIG. 9, which assures a satisfactory seal thereof with the orifice 20. The tabs 32, preferably having been integrally formed with the closure cap member 22, are then sonically welded to the exterior surface of the spout member 12 as shown, and the assembly of spout member 12 and closure cap member 22 can then be applied to suitably filled containers.

To open the dispenser cap 10, the consumer grasps the external gripper ribs of the closure cap member 22 and imparts a moderate twisting force thereto, sufficient to rupture the tabs 32 at the thin bridges 33, and thereafter removes the cap member 22. Due to the fact that there are no interfering structures on the spout member 12 and cap member 22, the latter will not be capable of being retained if the consumer replaces it. In such event, the top wall 26 does not press against the walls of the discharge orifice 20 with any degree of force, other than that possibly resulting from the weight of the closure cap member 22 itself, which is of no consequence, and re-sealing is thus effectively prevented.

The disclosed cap construction has the distinct advantage of extreme simplicity, making the manufacturing cost as low as possible. The integrity of the seal between the top wall 26 and the walls of the discharge orifice 20 is assured by the slight pressure established by the provision of the positioning shoulder 27 and the tension applied to the closure cap member 22 by the frangible tabs 32.

The provision of the scalloped wall surface 23 at the orifice 20 also constitutes an important feature of the invention, since it enhances the non-resealable mode of operation, by thwarting attempts to re-seal the dispenser. As noted above, this wall surface 23 could alternately have a modified shape, the important consideration being that it be out-of-round so as to resist attempts to re-seal the orifice as by means of a cylindrical stopper or plug constituted of wood, cloth, etc.

The device as above described is thus seen to represent a distinct advance and improvement in the dispensing container field.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is/claimed is:

1. A non-resealable dispenser cap construction comprising, in combination:

a) an elongate tapered, hollow spout member having a tip portion in which there is a discharge orifice, b) means for attaching the spout member over the opening of a container, c) a tapered closure cap member in the form of a cup having a flexible and deformable transverse closure wall, said cap member being mounted on the tip portion of the spout member with the transverse wall of the cap member engaging and closing over the said discharge orifice, said transverse closure wall being distorted and biased thereby, d) one of said members having a frangible tab which overlies and is permanently attached to the other member, e) said tab having a zone of weakness which can be readily ruptured upon the application of opposing rotative forces to the members whereby the cap member can be removed to expose said orifice for the discharge of the container contents through the spout member, f) said transverse closure wall of the cap member interfering with and preventing retentive return of the cap member on the spout member, g) said transverse wall of the cap member being convexly bulbous, having opposite concave and convex sides, said convex side engaging the discharge orifice, said engagement with the discharge orifice tending to reduce the degree of respective convexity and concavity of said wall.

2. A non-resealable dispenser cap construction as set forth in claim 1, wherein:

a) said closure wall has a substantially uniform thickness in the vicinity of the convex and concave sides.

3. A non-resealable dispenser cap construction as set forth in claim 1, wherein:

a) said closure cap member is constituted of resilient plastic substance.

4. A non-resealable dispenser cap construction as set forth in claim 1, wherein:

a) said spout member has an external shoulder, and b) said closure cap member has a depending wall engaging said shoulder to constitute a non-yielding positioning stop for the closure cap member on the spout member.

5. A non-resealable dispenser cap construction comprising, in combination:

a) an elongate tapered, hollow spout member having a tip portion in which there is a discharge orifice, said discharge orifice having axially-aligned inner and outer bores, the inner bore being of non-circular configuration and the outer bore being substantially circular, b) means for attaching the spout member over the opening of a container, c) a tapered closure cap member in the form of a cup having a flexible and deformable transverse closure wall, said cap member being mounted on the tip portion of the spout member with the transverse wall of the cap member engaging and closing over the said discharge orifice, said transverse closure wall being distorted and biased thereby, d) one of said members having a frangible tab which overlies and is permanently attached to the other member, e) said tab having a zone of weakness which can be readily ruptured upon the application of opposing rotative forces to the members whereby the cap member can be removed to expose said orifice for the discharge of the container contents through the spout member, f) said transverse wall of the cap member being convexly bulbous, having opposite, concave and convex sides, said convex side engaging the discharge orifice, said engagement with the discharge orifice tending to reduce the degree of convexity and concavity of said wall, g) said convex side extending into and downwardly beyond the uppermost rim of said outer bore, and sealingly engaging the periphery thereof, h) said inner bore resisting attempts to re-seal the discharge orifice as by a circular plug.

6. A non-resealable dispenser cap construction as set forth in claim 5, wherein:

a) said convex side being short of, and substantially out of contact with said inner bore.

7. A non-resealable dispenser cap construction as set forth in claim 5, wherein:

a) the inner bore has a substantially scalloped wall configuration.

8. A non-resealable dispenser cap construction comprising, in combination:

a) a hollow spout member having a tip portion in which there is a discharge orifice, b) means for attaching the spout member over the opening of a container, c) a closure cap member in the form of a cup having a flexible and deformable transverse closure wall characterized by a predetermined convexity at its underside, said cap member being mounted on the tip portion of the spout member with the transverse wall of the cap member engaging and closing over the said discharge orifice, d) frangible tab means on one of said members, said tab means overlying and being permanently attached to the other member, e) said tab means having a zone of weakness which can be readily ruptured upon the application of opposing rotative forces to the members whereby the cap member can be removed to expose said orifice for the discharge of the container contents through the spout member, f) said spout member having an external annular shoulder engageable with the closure cap member when the latter is assembled to the spout member, and during such assembled condition, said tab means maintaining engagement of the said shoulder and the cap member, while simultaneously distorting and biasing the transverse closure wall against its resilience and toward a reduced degree of convexity, g) the engagement of said shoulder and cap member positioning the latter, and said engagement also limiting the distortion of the transverse closure wall to a predetermined extent.

* * * * *